US011585348B2

(12) United States Patent
Iwakiri et al.

(10) Patent No.: US 11,585,348 B2
(45) Date of Patent: Feb. 21, 2023

(54) COMPRESSOR WHEEL DEVICE AND SUPERCHARGER

(71) Applicant: MITSUBISHI HEAVY INDUSTRIES ENGINE & TURBOCHARGER, LTD., Sagamihara (JP)

(72) Inventors: Kenichiro Iwakiri, Tokyo (JP); Takaya Futae, Tokyo (JP)

(73) Assignee: MITSUBISHI HEAVY INDUSTRIES ENGINE & TURBOCHARGER, LTD., Kanagawa (JP)

( * ) Notice: Subject to any disclaimer, the term of this patent is extended or adjusted under 35 U.S.C. 154(b) by 0 days.

(21) Appl. No.: 17/432,621

(22) PCT Filed: Mar. 14, 2019

(86) PCT No.: PCT/JP2019/010716
§ 371 (c)(1),
(2) Date: Aug. 20, 2021

(87) PCT Pub. No.: WO2020/183736
PCT Pub. Date: Sep. 17, 2020

(65) Prior Publication Data

US 2022/0145891 A1 May 12, 2022

(51) Int. Cl.
*F04D 29/28* (2006.01)
*F04D 17/10* (2006.01)
(Continued)

(52) U.S. Cl.
CPC ..... *F04D 17/10* (2013.01); *F04D 29/0513* (2013.01); *F04D 29/063* (2013.01); *F04D 29/122* (2013.01); *F04D 29/284* (2013.01)

(58) Field of Classification Search
CPC .... F04D 17/10; F04D 29/0513; F04D 29/063; F04D 29/122; F04D 29/284
(Continued)

(56) References Cited

U.S. PATENT DOCUMENTS 3,961,867 A * 6/1976 Woollenweber ..... F04D 29/057 415/110
4,340,317 A * 7/1982 Heitmann ..... F16D 1/06 417/407
(Continued)

FOREIGN PATENT DOCUMENTS

EP 0 129 311 A1 12/1984
JP 52-025562 7/1977
(Continued)

OTHER PUBLICATIONS

International Preliminary Report on Patentability issued in corresponding International Application No. PCT/JP2019/010716 dated Sep. 23, 2021.
(Continued)

*Primary Examiner* — Hung Q Nguyen
*Assistant Examiner* — Anthony Donald Taylor, Jr.
(74) *Attorney, Agent, or Firm* — Birch, Stewart, Kolasch & Birch, LLP

(57) ABSTRACT

A compressor wheel device comprises a compressor wheel attached to a rotary shaft and a thrust collar attached to the rotary shaft at a back surface of the compressor wheel. The compressor wheel includes: a wheel body part with a hub and at least one blade provided on an outer peripheral surface of the hub; and a sleeve part having a cylindrical shape projecting along an axis direction from a back surface of the hub and having an outer peripheral surface on which a sealing groove extending along a peripheral direction is formed. The thrust collar has a circular plate-like shape including: one surface including an abutting surface abutting on an end surface of the sleeve part and extending along a radial direction; and the other surface including a slidably-contacting surface slidably contacting a thrust bearing sup-
(Continued)

porting the rotary shaft in a thrust direction and extending along the radial direction.

9 Claims, 8 Drawing Sheets

(51) Int. Cl.
*F04D 29/051* (2006.01)
*F04D 29/063* (2006.01)
*F04D 29/12* (2006.01)

(58) Field of Classification Search
USPC ..... 416/204 R
See application file for complete search history.

(56) References Cited

U.S. PATENT DOCUMENTS 4,705,463 A * 11/1987 Joco ..... F04D 29/266 29/889.23
4,986,733 A * 1/1991 Fleury ..... F04D 29/266 415/230
5,176,497 A * 1/1993 Deacon ..... F04D 29/266 415/230
5,193,989 A * 3/1993 Fleury ..... F01D 5/025 417/407
6,012,901 A * 1/2000 Battig ..... F01D 5/025 416/244 A
6,845,617 B1 * 1/2005 Allen ..... F02B 37/10 123/565
7,010,917 B2 * 3/2006 Billington ..... F04D 29/266 417/407
7,374,402 B2 * 5/2008 Thiele ..... F16D 1/0852 416/204 R
7,909,578 B2 * 3/2011 Nishiyama ..... F01D 5/025 416/204 A
2004/0131469 A1 * 7/2004 Billington ..... F04D 29/266 416/204 R
2005/0232775 A1 * 10/2005 Thiele ..... F04D 29/266 416/204 R
2010/0132358 A1 * 6/2010 Purdey ..... F16C 17/26 60/605.3
2013/0330193 A1 * 12/2013 Asano ..... F04D 29/266 416/169 R
2015/0275921 A1 * 10/2015 Pinkney ..... F01D 5/025 416/204 R
2016/0208821 A1 * 7/2016 Morath ..... F02C 6/12
2017/0234213 A1 * 8/2017 Futae ..... F04D 29/051 415/110

FOREIGN PATENT DOCUMENTS

JP 59-200098 11/1984
JP 2009-208138 A 9/2009
JP 2009208138 A * 9/2009 ..... F04D 29/28
JP 2016-500140 A 1/2016
JP 2018-109367 A 7/2018
WO WO 2014/083325 A1 6/2014
WO WO 2016/079781 A1 5/2016

OTHER PUBLICATIONS

International Search Report issued in corresponding international application No. PCT/JP2019/010716 dated Jun. 11, 2019.

* cited by examiner

COMPRESSOR WHEEL DEVICE AND SUPERCHARGER

TECHNICAL FIELD

The present disclosure relates to a compressor wheel device including a compressor wheel and a thrust collar, and a supercharger including the compressor wheel device.

BACKGROUND

One compressor wheel to be mounted on a supercharger includes a hub and a plurality of blades provided on an outer peripheral surface of the hub, and a through hole penetrating the hub in an axis direction is formed. This compressor wheel has what is called a through-bore configuration in which a rotary shaft is passed through the through hole and a nut is threadedly engaged with a projection projecting from a wheel front edge of the rotary shaft, thereby coupling the compressor wheel mechanically to the rotary shaft.

The foregoing through-bore configuration is known to cause a stress concentration part at an inner peripheral surface of the foregoing through hole. The stress concentration part occurs in the vicinity of a maximum outer diameter position. For example, while a compressor to be mounted on commercial vehicles, industrial superchargers, etc. is required to achieve a high pressure ratio, an outlet temperature at the compressor is increased in response to increase in the pressure ratio. This makes creep strength at the foregoing stress concentration part problematic. Using a high-strength material such as titanium for the compressor wheel for ensuring creep strength is not preferred as it results in cost increase.

One compressor wheel includes a wheel body member including the hub and the blade described above, and a circular cylindrical sleeve member (see Patent Document 1). Patent Document 1 discloses a compressor wheel in which an axis end surface of the sleeve member is brought into contact with the center of the rear surface of the wheel body member and a position of the contact is melted with heat generated by rotating the sleeve member, thereby attaching the wheel body part and the sleeve member to each other fixedly. Patent Document 1 further discloses what is called a boreless configuration in which a tip of the rotary shaft is threadedly engaged with a female screw part formed at an inner peripheral surface of the sleeve member to couple the compressor wheel mechanically to the rotary shaft.

In the foregoing boreless configuration, the female screw part is provided closer to a back surface than the vicinity of the maximum outer diameter position to allow reduction in the occurrence of the stress concentration part. Thus, as compared to the through-bore configuration, this eliminates the need to increase creep strength to allow corresponding reduction in material cost.

CITATION LIST

Patent Literature

Patent Document 1: JPS59-200098A

SUMMARY

Technical Problem

However, the length of the compressor wheel in the axis direction is longer by the length of the sleeve member in the foregoing boreless configuration than in the foregoing through-bore configuration. This causes not only size increase of a compressor but also a risk of increasing shaft vibration or reducing a critical speed. The length of the compressor in the axis direction might be reduced by making the diameter of a thrust collar attached to the rotary shaft at the back surface of the compressor wheel greater than that of the sleeve member and arranging the thrust collar in such a manner as to cover the sleeve member. However, this causes a risk of complicating the thrust collar and increasing manufacturing cost for a supercharger.

In view of the foregoing circumstances, at least one embodiment of the present invention is intended to provide a compressor wheel device capable of preventing complication of a configuration and reducing manufacturing cost.

Solution to Problem (1) A compressor wheel device according to at least one embodiment of the present invention includes a compressor wheel attached to a rotary shaft and a thrust collar attached to the rotary shaft at a back surface of the compressor wheel.

The compressor wheel includes:

a wheel body part with a hub and at least one blade provided on an outer peripheral surface of the hub; and a sleeve part having a cylindrical shape projecting along an axis direction from a back surface of the hub and having an outer peripheral surface on which a sealing groove extending along a peripheral direction is formed.

The thrust collar has a circular plate-like shape including:

one surface including an abutting surface abutting on an end surface of the sleeve part and extending along a radial direction; and the other surface including a slidably-contacting surface slidably contacting a thrust bearing supporting the rotary shaft in a thrust direction and extending along the radial direction.

According to the foregoing configuration (1), the compressor wheel device includes the compressor wheel having the wheel body part and the sleeve part, and the thrust collar. The thrust collar has a circular plate-like shape including the one surface including the abutting surface abutting on the end surface of the sleeve part and extending along the radial direction, and the other surface including the slidably-contacting surface slidably contacting the thrust bearing supporting the rotary shaft in the thrust direction and extending along the radial direction. This is a simple configuration easy to manufacture. The thrust collar can be fitted on a supercharger without the need of distinguishing between the one surface and the other surface to achieve favorable fitting performance. Thus, the foregoing configuration makes it possible to prevent complication of the configuration of the compressor wheel device and to reduce manufacturing cost for the compressor wheel device.

If a sealing mechanism part of the supercharger has a long peripheral length, a probability of leakage of a lubricant oil is increased correspondingly. To prevent leakage of the lubricant oil, a risk of complication of the sealing mechanism part may be caused. According to the foregoing configuration (1), the presence of the sealing groove at the sleeve part makes it possible to prevent increase in the peripheral length of the sealing mechanism part of the supercharger having a configuration including the sealing groove and to prevent complication of the sealing mechanism part. As a result, complication of the supercharger equipped with the compressor wheel device is prevented and reduction in manufacturing cost for the supercharger is achieved.

(2) According to some embodiments, in the compressor wheel device described in (1), the wheel body part and the sleeve part are formed integrally using the same material.

If the wheel body part and the sleeve part are separate parts, work of fitting the wheel body part and the sleeve part together is required. According to the foregoing configuration (2), as the wheel body part and the sleeve part are formed integrally using the same material, favorable fitting performance is achieved as compared to the case where the wheel body part and the sleeve part are separate parts. As forming the wheel body part and the sleeve part integrally is not difficult process, risk of reducing processing performance is not caused. Thus, the foregoing configuration makes it possible to reduce manufacturing cost for the compressor wheel device further.

(3) According to some embodiments, in the compressor wheel device described in (2), the sealing groove has a bottom surface configured to form a clearance between the bottom surface and an inner peripheral surface of a sealing member supported by a housing housing the compressor wheel.

Generally, for encouraging weight reduction of the compressor wheel, a low-strength material such as aluminum or an aluminum alloy is used in some cases as a material for the compressor wheel. If the wheel body part and the sleeve part are formed integrally, the sleeve part may be made of a low-strength material. According to the foregoing configuration (3), as the bottom surface of the sealing groove is configured to form the clearance between the bottom surface and the inner peripheral surface of the sealing member supported by the housing, it is possible to prevent wear or damage of the sealing groove of the sleeve part as a result of sliding motion relative to the sealing member.

(4) According to some embodiments, in the compressor wheel device described in (2) or (3), surface treatment process for improving at least one of rigidity and sliding performance is performed on an area of the sleeve part including the sealing groove.

As described above, aluminum or an aluminum alloy may be used at the sleeve part. If these materials are used at the sealing groove likely to make sliding motion relative to a different member, wear or damage may develop easily due to insufficient rigidity or galling may be caused easily due to bad sliding performance. According to the foregoing configuration (4), as the surface treatment process for improving at least one of rigidity and sliding performance is performed on the area of the sleeve part including the sealing groove, it is possible to prevent wear or damage of the sealing groove due to insufficient rigidity or to prevent the occurrence of galling.

(5) According to some embodiments, in the compressor wheel device described in any one of (2) to (4), with a maximum outer diameter of the hub defined as D, a position of connection between the wheel body part and the sleeve part is configured to be separated from a maximum outer diameter position of the hub by 0.03 D or more in the axis direction.

Centrifugal stress becomes maximum in the vicinity of the maximum outer diameter position of the hub in the axis direction. According to the foregoing configuration (5), with the maximum outer diameter of the hub defined as D, the position of connection between the wheel body part and the sleeve part is configured to be separated from the maximum outer diameter position of the hub by 0.03 D or more in the axis direction. This allows reduction in the centrifugal stress acting on the position of connection. Reducing the centrifugal stress acting on the position of connection allows reduction in the outer diameter of the sleeve part, making it possible to prevent increase in the peripheral length of the sealing mechanism part of the supercharger.

(6) According to some embodiments, in the compressor wheel device described in any one of (2) to (5), a connection between the wheel body part and the sleeve part is formed into an arc-like shape recessed into the compressor wheel taken at a section including an axis line direction of the rotary shaft.

According to the foregoing configuration (6), as the connection between the wheel body part and the sleeve part is formed into an arc-like shape recessed into the compressor wheel taken at a section including the axis line direction of the rotary shaft, it is possible to prevent the occurrence of stress concentration at the connection. Preventing the occurrence of stress concentration at the connection allows reduction in the outer diameter of the sleeve part, making it possible to prevent increase in the peripheral length of the sealing mechanism part of the supercharger.

(7) According to some embodiments, in the compressor wheel device described in any one of (1) to (6), the sleeve part has an inner peripheral surface provided with a screw groove with which the rotary shaft is threadedly engaged.

According to the foregoing configuration (7), the compressor wheel has what is called a boreless configuration of being coupled to the rotary shaft mechanically by threadedly engaging the rotary shaft with the screw groove formed at the inner peripheral surface of the sleeve part separated from the maximum outer diameter position of the hub. The foregoing configuration allows reduction in the occurrence of a stress concentration part. As compared to the through-bore configuration, this eliminates the need to increase creep strength at the wheel body part to allow corresponding reduction in material cost for the wheel body part.

(8) According to some embodiments, in the compressor wheel device described in (1), the sleeve part includes one end portion configured to be fixedly coupled to the wheel body part by being press-fitted into a recess formed at the back surface of the hub, and is formed using a material having higher wear resistance than that of the wheel body part.

According to the foregoing configuration (8), as press-fitting the one end portion of the sleeve part into the recess of the hub makes the wheel body part and the sleeve part integral with each other, work of fitting the wheel body part and the sleeve part is done easily. Furthermore, as the wheel body part and the sleeve part are fitted on the supercharger while being integral with each other, favorable fitting performance is achieved. Thus, the foregoing configuration makes it possible to suppress increase in manufacturing cost occurring by forming the wheel body part and the sleeve part as separate parts. Furthermore, as the sleeve part having the sealing groove is made of a material of higher wear resistance than that of the wheel body part, it is possible to prevent wear or damage of the sealing groove.

(9) According to some embodiments, in the compressor wheel device described in (8), the one end portion has a tip configured to be located closer to the back surface of the compressor wheel than a maximum outer diameter position of the hub.

According to the foregoing configuration (9), the tip of the one end portion of the sleeve part is configured to be located closer to the back surface of the compressor wheel than the maximum outer diameter position of the hub. Unlike the through-bore configuration, this makes it possible to reduce the occurrence of a stress concentration part at the wheel body part. This eliminates the need to increase creep strength at the wheel body part to allow corresponding reduction in material cost for the wheel body part.

(10) According to some embodiments, in the compressor wheel device described in (8) or (9), the sleeve part has an inner peripheral surface provided with a screw groove with which the rotary shaft is threadedly engaged.

According to the foregoing configuration (10), the compressor wheel is coupled to the rotary shaft mechanically by threadedly engaging the rotary shaft with the screw groove formed at the inner peripheral surface of the sleeve part. As the sleeve part with the screw groove is formed using a material having higher wear resistance than that of the wheel body part, it is possible to fasten the rotary shaft and the compressor wheel to each other fixedly through the threaded engagement.

(11) A supercharger according to at least one embodiment of the present invention includes:

a rotary shaft;

the compressor wheel device described in any one of (1) to (10);

a housing configured to house the compressor wheel device; and a sealing member supported by the housing and configured to form a sealing mechanism part between the sealing member and the sealing groove.

According to the foregoing configuration (11), as the supercharger includes the compressor wheel device including the sleeve part with the sealing groove, and the sealing member supported by the housing and forming the sealing mechanism part between the sealing member and the sealing groove, it is possible to prevent increase in the peripheral length of the sealing mechanism part and to prevent complication of the sealing mechanism part. Thus, the foregoing configuration makes it possible to prevent complication of the configuration of the supercharger and to reduce manufacturing cost for the supercharger.

Advantageous Effects

According to at least one embodiment of the present invention, a compressor wheel device capable of preventing complication of a configuration and reducing manufacturing cost is provided.

DETAILED DESCRIPTION

Figure 1:
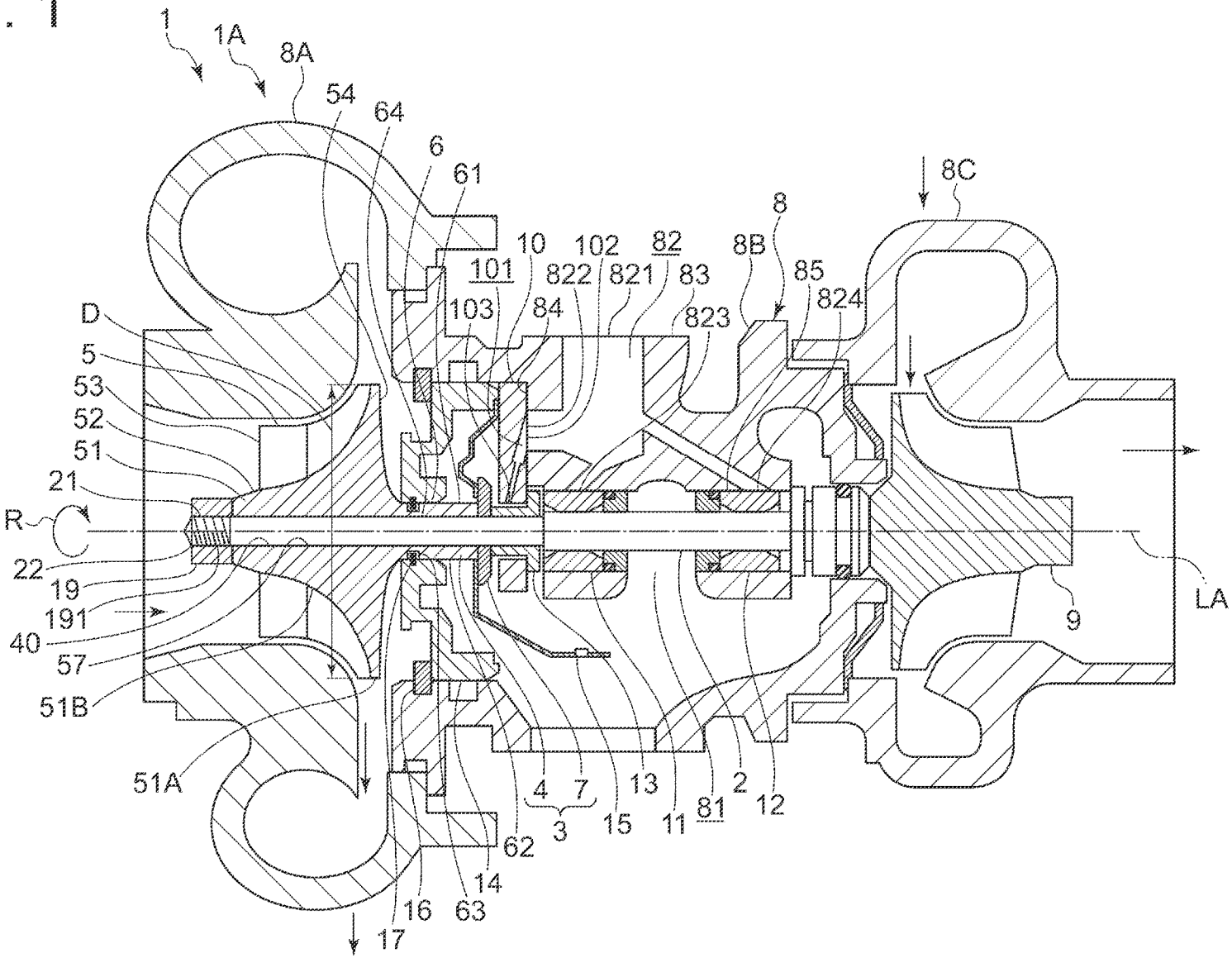
FIG. 1 is a schematic sectional view taken along an axis line of a supercharger including a compressor wheel device according to one embodiment.

Embodiments of the present invention will now be described in detail with reference to the accompanying drawings. It is intended, however, that unless particularly specified, dimensions, materials, shapes, relative positions and the like of components described in the embodiments or shown in the drawings shall be interpreted as illustrative only and not limitative of the scope of the present invention.

For example, an expression indicating a relative or absolute location such as "in one direction," "along one direction," "parallel," "perpendicular," "center," "concentric," or "coaxial" is used not only to indicate such a location strictly but also to indicate a state in which relative displacement occurs with a tolerance or at an angle or a distance of such a degree as to fulfill the same function.

For example, expressions indicating equality between things such as "same," "equal," and "uniform" are used not only to indicate a strictly equal state but also to indicate a state in the presence of a tolerance or a difference of such a degree as to achieve the same function.

For example, an expression indicating a shape such as a rectangular shape or a circular cylindrical shape is used not only to indicate a shape such as a rectangular shape or a circular cylindrical shape in a geometrically strict sense but also to indicate a shape with unevenness or a chamfer formed within a range in which the same effect is fulfilled.

On the other hand, an expression "comprising," "including," or "having" one constituting element is not an exclusive expression of eliminating the presence of other constituting elements.

A comparable structure will be given the same sign and, in some cases, description thereof will be omitted.

FIG. 1 is a schematic sectional view taken along an axis line of a supercharger including a compressor wheel device according to one embodiment. In FIG. 1, arrows show directions in which a combustion gas (air) and an exhaust gas flow.

As shown in FIG. 1, a compressor wheel device 3 according to some embodiments includes a compressor wheel 4 attached to a rotary shaft 2 extending along an axis line LA, and a thrust collar 7 attached to the rotary shaft 2 at a back surface 54 (right side in the drawing) of the compressor wheel 4. As shown in FIG. 1, the compressor wheel device 3 is mounted on a supercharger 1.

As shown in FIG. 1, the supercharger 1 according to some embodiments includes the rotary shaft 2, the compressor wheel device 3, and a housing 8 configured to house the rotary shaft 2 and the compressor wheel device 3.

As shown in FIG. 1, according to the illustrated embodiment, the supercharger 1 is composed of a turbocharger for automobile further including a turbine wheel 9 attached to the rotary shaft 2, a thrust bearing 10 configured to support the rotary shaft 2 in a thrust direction, a journal bearing 11 and a journal bearing 12 configured to support the rotary shaft 2 in a radial direction, a thrust collar 13 on the other side, an insert 14, an oil deflector 15, a snap ring 16, and a sealing member 17. The thrust bearing 10 and the journal bearings 11 and 12 each support the rotary shaft 2 rotatably.

As shown in FIG. 1, the turbine wheel 9 is attached to the rotary shaft 2 on the opposite side of the compressor wheel 4 relative to the thrust collar 7. In the following, a direction in which the axis line LA extends will simply be called an axis direction, a direction perpendicular to the axis line LA will simply be called a radial direction, a side (left side in the drawing) on which the compressor wheel 4 is located in the axis direction will be called one side, and a side (right side in the drawing) on which the turbine wheel 9 is located in the axis direction will be called the other side.

As shown in FIG. 1, according to the illustrated embodiment, the housing 8 includes a compressor housing 8A configured to house the compressor wheel 4, a bearing housing 8B configured to house the thrust bearing 10 and the journal bearings 11 and 12, and a turbine housing 8C configured to house the turbine wheel 9.

As shown in FIG. 1, the bearing housing 8B is arranged between the compressor housing 8A and the turbine housing 8C in the axis direction. The bearing housing 8B has an end on the one side fixedly coupled to the compressor housing 8A by a fastening device not shown in the drawings, and an end on the other side fixedly coupled to the turbine housing 8C. The fastening device is a bolt, a nut, or a V clamp, for example.

The supercharger 1 (turbocharger) is configured to rotate the turbine wheel 9 using an exhaust gas introduced into the turbine housing 8C from an internal combustion system such as an engine and to rotate the compressor wheel 4 mechanically coupled to the turbine wheel 9 through the rotary shaft 2. The supercharger 1 (turbocharger) is configured to compress a combustion gas (air) introduced into the compressor housing 8A to generate compressed air by rotating the compressor wheel 4, and to feed the compressed air to the foregoing internal combustion system.

As shown in FIG. 1, according to the illustrated embodiment, the turbine housing 8C is configured to introduce an exhaust gas from outside of the radial direction and to exhaust the exhaust gas outwardly along the axis direction after the exhaust gas is used for rotating the turbine wheel 9. As shown in FIG. 1, the compressor housing 8A is configured to introduce air from outside of the axis direction and to exhaust the combustion gas outwardly along the radial direction after the combustion gas is passed through the compressor wheel 4 and a diffuser flow path.

As shown in FIG. 1, according to the illustrated embodiment, the bearing housing 8B includes internal space 81 configured to allow the rotary shaft 2 to pass therethrough along the axis direction, and an oiling flow path 82 for flowing a lubricant oil from outside of the bearing housing 8B into the internal space 81 that are defined inside the bearing housing 8B.

As shown in FIG. 1, the internal space 81 accommodates the thrust collar 7, the thrust bearing 10, the journal bearings 11 and 12, the other-side thrust collar 13, the insert 14, the oil deflector 15, the snap ring 16, and the sealing member 17. The journal bearing 11 is arranged closer to the one side than the journal bearing 12 and closer to the other side than the other-side thrust collar 13.

As shown in FIG. 1, the bearing housing 8B is provided with an oiling inlet 821 formed at an outer surface 83 of the bearing housing 8B, a thrust-side outlet 822 formed at a step surface 84 of the bearing housing 8B, and a journal-side outlet 823 and a journal-side outlet 824 formed at an inner surface 85 of the bearing housing 8B. Part of the lubricant oil introduced into the oiling flow path 82 through the oiling inlet 821 passes through the journal-side outlets 823 and 824 to be used for lubricating the journal bearings 11 and 12.

As shown in FIG. 1, the thrust bearing 10 includes an oiling introduction path 101 for flow of the lubricant oil defined inside the thrust bearing 10. As shown in FIG. 1, the thrust bearing 10 is provided with an oiling communication port 102 communicating with the thrust-side outlet 822, and an exhaust port 103 for exhaustion of the lubricant oil having flowed through the oiling introduction path 101 to outside. Part of the lubricant oil introduced into the oiling flow path 82 through the oiling inlet 821 passes through the thrust-side outlet 822 and the oiling communication port 102, is introduced into the oiling introduction path 101, is then exhausted to outside of the thrust bearing 10 through the exhaust port 103, and is introduced into a gap between each of the thrust collar 7 and the other-side thrust collar 13 and the thrust bearing 10.

As shown in FIG. 1, the compressor wheel 4 includes a wheel body part 5 including a hub 51 and at least one blade 53 provided on an outer peripheral surface 52 of the hub 51, and a sleeve part 6 having a cylindrical shape projecting along the axis direction from the back surface 54 of the hub 51. The sleeve part 6 has an outer peripheral surface 61 on which at least one sealing groove 62 extending along a peripheral direction is formed. The wheel body part 5 and the sleeve part 6 are configured to rotate integrally with the rotary shaft 2.

As shown in FIG. 1, according to the illustrated embodiment, the at least one blade 53 includes a plurality of blades 53 arranged in the peripheral direction of the hub 51 to be spaced from each other. The sleeve part 6 is provided coaxially with the hub 51 and projects from the center of the back surface 54 of the hub 51. The hub 51 includes a disk part 51A extending along the radial direction, and a nose part 51B of a smaller diameter than the disk part 51A and provided closer to the one side than the disk part 51A. The sleeve part 6 is configured into a smaller diameter than the disk part 51A of the hub 51.

Figure 2:
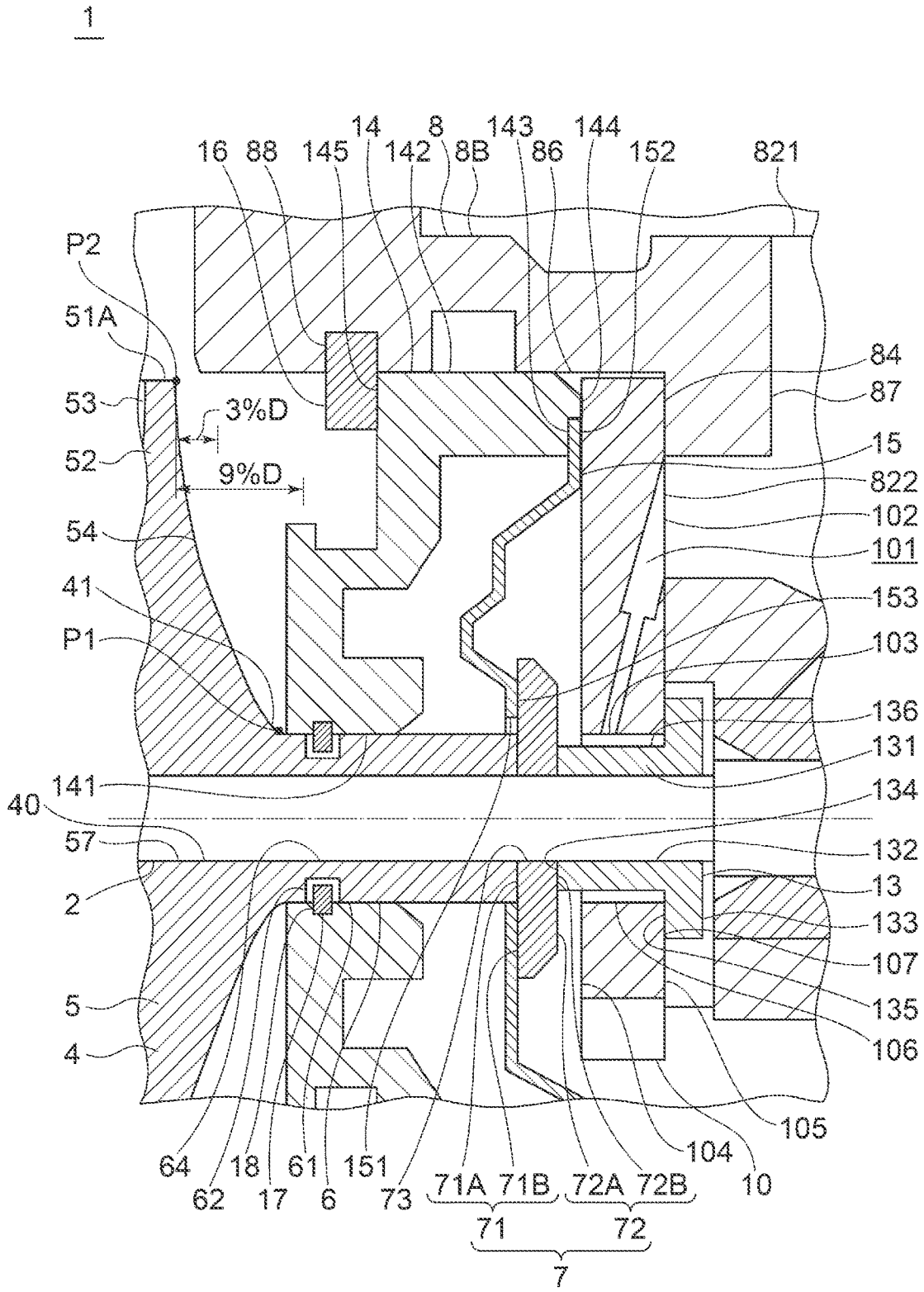
FIG. 2 is a schematic partially enlarged sectional view showing a sleeve part and its vicinity in an enlarged manner in the compressor wheel device shown in FIG. 1.
Figure 3:
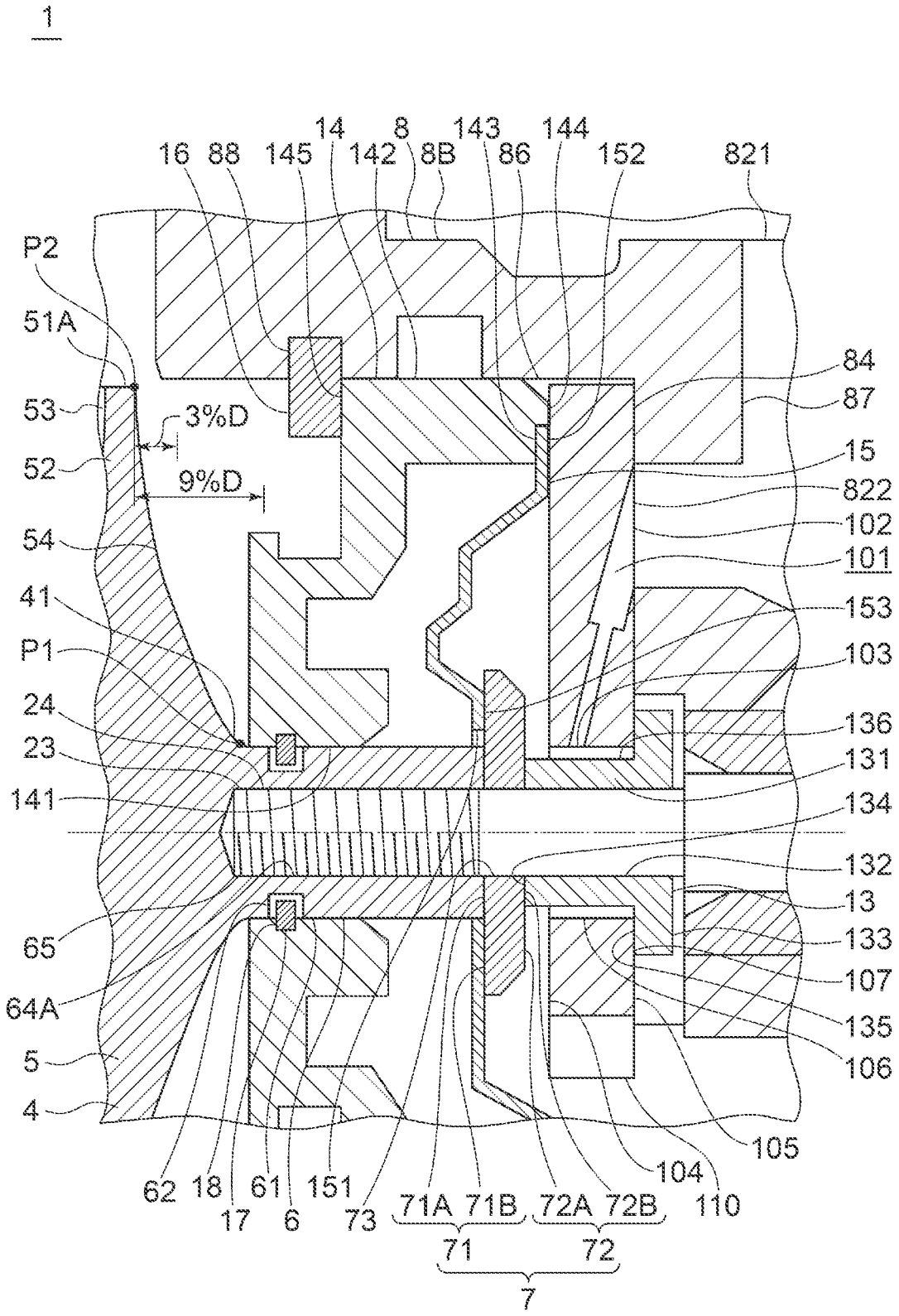
FIG. 3 is a schematic partially enlarged sectional view corresponding to FIG. 2 showing a compressor wheel device according to a different embodiment.

FIG. 2 is a schematic partially enlarged sectional view showing the sleeve part and its vicinity in an enlarged manner in the compressor wheel device shown in FIG. 1. FIG. 3 is a schematic partially enlarged sectional view corresponding to FIG. 2 showing a compressor wheel device according to a different embodiment.

As shown in FIGS. 2 and 3, the thrust collar 7 has a circular plate-like shape including one surface 71 located at one end (on the one side) of a thickness direction (axis direction) and extending along the radial direction, and the other surface 72 located at the other end (on the other side) of the thickness direction and extending along the radial direction.

As shown in FIGS. 2 and 3, the one surface 71 includes an abutting surface 71A abutting on an end surface 63 of the sleeve part 6. As shown in FIGS. 2 and 3, the other surface 72 includes a slidably-contacting surface 72A slidably contacting an end surface 104 of the thrust bearing 10.

As shown in FIGS. 2 and 3, the thrust collar 7 is provided with a through hole 73 penetrating the thrust collar 7 along the thickness direction, and the rotary shaft 2 is passed through the through hole 73. The thrust collar 7 is configured to rotate integrally with the rotary shaft 2. The thrust collar 7 is closer to the one side than the other-side thrust collar 13.

As shown in FIGS. 2 and 3, the other-side thrust collar 13 includes a circular cylindrical body part 131 with a through hole 132 through which the rotary shaft 2 is passed, and a flange part 133 projecting from an outer peripheral edge of the body part 131 on the other side along the radial direction.

The other-side thrust collar 13 is configured to rotate integrally with the rotary shaft 2.

As shown in FIGS. 2 and 3, the body part 131 has an end surface 134 located on the one side and extending along the radial direction to abut on the other surface 72 of the thrust collar 7. In other words, the other surface 72 of the thrust collar 7 includes a collar abutting surface 72B provided inside the slidably-contacting surface 72A in the radial direction and abutting on the end surface 134 of the other-side thrust collar 13.

As shown in FIGS. 2 and 3, the flange part 133 has a step surface 135 located on the one side and extending along the radial direction to slidably contact an end surface 105 of the thrust bearing 10.

As shown in FIGS. 2 and 3, the thrust bearing 10 is formed into a plate-like shape extending along the radial direction, and is provided with a passage hole 106 configured to extend along the axis direction and to cause the body part 131 of the other-side thrust collar 13 to pass therethrough loosely. As shown in FIGS. 2 and 3, the thrust bearing 10 includes the end surface 104 located on the one side and extending along the radial direction, and the end surface 105 located on the other side and extending along the radial direction.

The thrust bearing 10 has an inner peripheral edge 107 arranged in a gap in the axis direction between the slidably-contacting surface 72A of the thrust collar 7 and the step surface 135 of the other-side thrust collar 13.

When thrust power acts on the rotary shaft 2, the end surface 104 slidably comes into contact with the slidably-contacting surface 72A or the end surface 105 slidably comes into contact with the step surface 135. By doing so, the thrust bearing 10 supports the rotary shaft 2 in the thrust direction. The inner surface of the passage hole 106 of the thrust bearing 10 is configured to slidably come into contact with an outer peripheral surface 136 of the body part 131 of the other-side thrust collar 13 in response to the rotation of the rotary shaft 2.

As shown in FIGS. 2 and 3, according to the illustrated embodiment, the oiling communication port 102 is formed at the end surface 105 and the exhaust port 103 is formed at the inner surface of the passage hole 106. The lubricant oil exhausted through the exhaust port 103 is introduced into between the inner surface of the passage hole 106 of the thrust bearing 10 and the outer peripheral surface 136 of the other-side thrust collar 13, into between the end surface 104 of the thrust bearing 10 and the slidably-contacting surface 72A of the thrust collar 7, and into between the end surface 105 of the thrust bearing 10 and the step surface 135 of the other-side thrust collar 13. Then, the lubricant oil forms a liquid film in response to the rotation of the rotary shaft 2.

As shown in FIGS. 2 and 3, the insert 14 is an annular member having a through hole 141 penetrating the insert 14 along the axis direction and is configured to cause the sleeve part 6 to pass through the through hole 141 loosely. The insert 14 is arranged in such a manner that the inner surface of the through hole 141 faces the outer peripheral surface 61 including the sealing groove 62 with a gap therebetween.

As shown in FIGS. 2 and 3, the insert 14 has a projection 142 projecting from an outer periphery toward the thrust bearing 10 along the axis direction. The projection 142 has a tip 144 projecting from a step surface 143 on the other side extending in the radial direction, and the tip 144 abuts on an outer peripheral edge of the end surface 104 of the thrust bearing 10.

As shown in FIGS. 2 and 3, the bearing housing 8B includes a covering part 86 extending along the axis direction in such a manner as to cover the thrust bearing 10 and the insert 14 from their outer peripheries, and an inward projection 87 projecting inwardly in the radial direction at a position closer to the other side than the thrust bearing 10 in the axis direction and extending along the radial direction. The inward projection 87 has the step surface 84 abutting on the end surface 105 of the thrust bearing 10.

As shown in FIGS. 2 and 3, the projection 142 of the insert 14 has a rear end surface 145 on the one side abutting on the snap ring 16 of an arc-like shape (movement regulating member) fitting in an inner peripheral groove 88 formed at the covering part 86 of the bearing housing 8B. The insert 14 is pressed with the snap ring 16 toward the thrust bearing 10. In other words, the thrust bearing 10 and the insert 14 are caught at their outer peripheral edges by the inward projection 87 of the bearing housing 8B and the snap ring 16 respectively. Namely, the thrust bearing 10 and the insert 14 are supported on the outer periphery of the rotary shaft 2 by the bearing housing 8B (housing 8).

As shown in FIGS. 2 and 3, the oil deflector 15 is arranged closer to the other side than the insert 14. The oil deflector 15 is an annular member having a through hole 151 penetrating the oil deflector 15 along the axis direction and is configured to cause the sleeve part 6 to pass through the through hole 151 loosely.

As shown in FIGS. 2 and 3, the oil deflector 15 extends along the radial direction and has an outer peripheral edge 152 caught between the step surface 143 of the insert 14 and the outer peripheral edge of the end surface 104 of the thrust bearing 10. Namely, the oil deflector 15 is supported on the outer periphery of the rotary shaft 2 by the bearing housing 8B (housing 8) through the thrust bearing 10 and the insert 14. The oil deflector 15 is configured in such a manner that an inner peripheral edge 153 at a surface of the oil deflector 15 on the other side slidably contacts the one surface 71 of the thrust collar 7.

The one surface 71 includes a slidably-contacting surface 71B arranged outside the abutting surface 71A in the radial direction and slidably contacting the inner peripheral edge 153 of the oil deflector 15. Namely, as shown in FIGS. 2 and 3, the thrust collar 7 has a projection 74 projecting further outwardly in the radial direction than the outer peripheral surface 61 of the sleeve part 6, and a surface of the projection 74 on the one side functions as the slidably-contacting surface 71B.

As shown in FIGS. 2 and 3, the sealing member 17 is configured to form a sealing mechanism part 18 between the sealing member 17 and the sealing groove 62 of the sleeve part 6. The sealing member 17 is supported on the outer periphery of the rotary shaft 2 by the bearing housing 8B (housing 8) through the insert 14.

According to the embodiment shown in FIGS. 1 and 2, the compressor wheel 4 is provided with a through hole 40 allowing the rotary shaft 2 to pass therethrough along the axis direction. As shown in FIG. 1, the through hole 40 includes a through hole 57 penetrating the wheel body part 5 along the axis direction, and a through hole 64 communicating with the through hole 57 and penetrating the sleeve part 6 along the axis direction. The compressor wheel 4 is coupled to the rotary shaft 2 mechanically and fixedly by passing the rotary shaft 2 through the through hole 40, and threadedly engaging a screw groove 191 (female screw part) formed at the inner peripheral surface of a nut member 19 with a threaded engagement part 22 (male screw part) formed at the outer peripheral surface of a projection 21 projecting from a wheel front edge of the rotary shaft 2.

Namely, the compressor wheel 4 according to the embodiment shown in FIGS. 1 and 2 has what is called a through-bore configuration.

According to the embodiment shown in FIG. 3, the compressor wheel 4 is coupled to the rotary shaft 2 mechanically and fixedly by threadedly engaging a threaded engagement part 24 (male screw part) formed at the outer peripheral surface of a tip 23 of the rotary shaft 2 with a screw groove 65 (female screw part) formed at an inner peripheral surface 64A of the sleeve part 6. Namely, the compressor wheel 4 according to the embodiment shown in FIG. 3 has what is called a boreless configuration.

As shown in FIGS. 2 and 3, the compressor wheel device 3 according to some embodiments includes the compressor wheel 4 and the thrust collar 7. The compressor wheel 4 includes the wheel body part 5 and the sleeve part 6 having the sealing groove 62. The thrust collar 7 has a circular plate-like shape including the one surface 71 including the abutting surface 71A, and the other surface 72 including the slidably-contacting surface 72A.

According to the foregoing configuration, the compressor wheel device 3 includes the compressor wheel 4 having the wheel body part 5 and the sleeve part 6, and the thrust collar 7. The thrust collar 7 has a circular plate-like shape including the one surface 71 including the abutting surface 71A abutting on the end surface 63 of the sleeve part 6 and extending along the radial direction, and the other surface 72 including the slidably-contacting surface 72A slidably contacting the thrust bearing 10 supporting the rotary shaft 2 in the thrust direction and extending along the radial direction. This is a simple configuration easy to manufacture. The thrust collar 7 can be fitted on the supercharger 1 without the need of distinguishing between the one surface 71 and the other surface 72 to achieve favorable fitting performance. Thus, the foregoing configuration makes it possible to prevent complication of the configuration of the compressor wheel device 3 and to reduce manufacturing cost for the compressor wheel device 3.

If the sealing mechanism part 18 of the supercharger 1 has a long peripheral length, a probability of leakage of the lubricant oil is increased correspondingly. To prevent leakage of the lubricant oil, a risk of complication of the sealing mechanism part 18 may be caused. According to the foregoing configuration, the presence of the sealing groove 62 at the sleeve part 6 makes it possible to prevent increase in the peripheral length of the sealing mechanism part 18 of the supercharger 1 having a configuration including the sealing groove 62 and to prevent complication of the sealing mechanism part 18. As a result, complication of the supercharger 1 equipped with the compressor wheel device 3 is prevented and reduction in manufacturing cost for the supercharger 1 is achieved.

As shown in FIGS. 2 and 3, according to some embodiments, the wheel body part 5 and the sleeve part 6 are formed integrally using the same material. If the wheel body part 5 and the sleeve part 6 are separate parts, work of fitting the wheel body part 5 and the sleeve part 6 together is required. According to the foregoing configuration, as the wheel body part 5 and the sleeve part 6 are formed integrally using the same material, favorable fitting performance is achieved as compared to the case where the wheel body part 5 and the sleeve part 6 are separate parts. As forming the wheel body part 5 and the sleeve part 6 integrally is not difficult process, risk of reducing processing performance is not caused. Thus, the foregoing configuration makes it possible to reduce manufacturing cost for the compressor wheel device 3 further.

Figure 4:
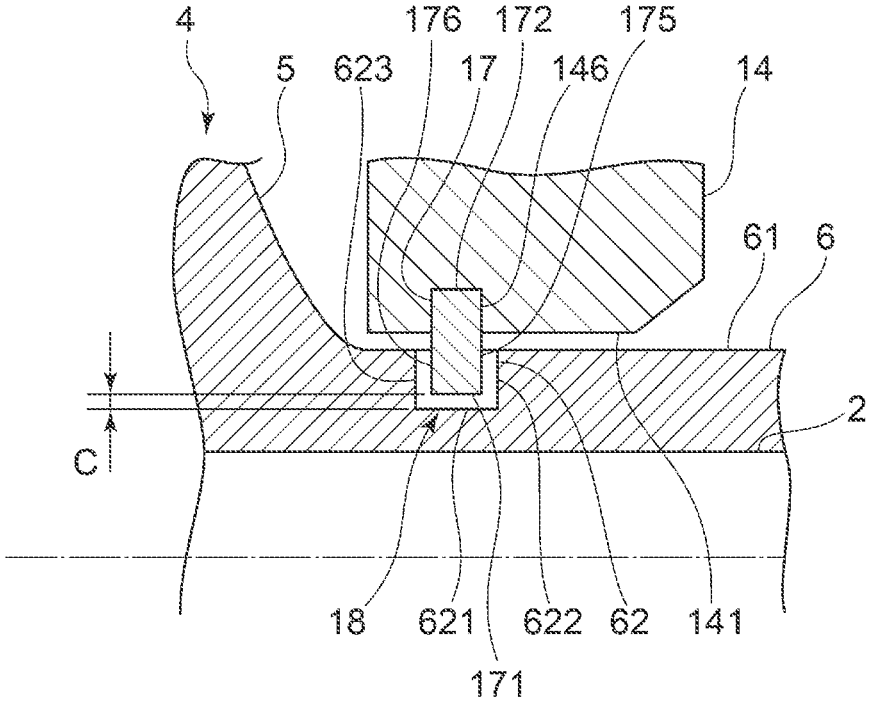
FIG. 4 is a schematic partially enlarged sectional view showing a sealing mechanism part and its vicinity in an enlarged manner in the supercharger including the compressor wheel device according to one embodiment.
Figure 5:
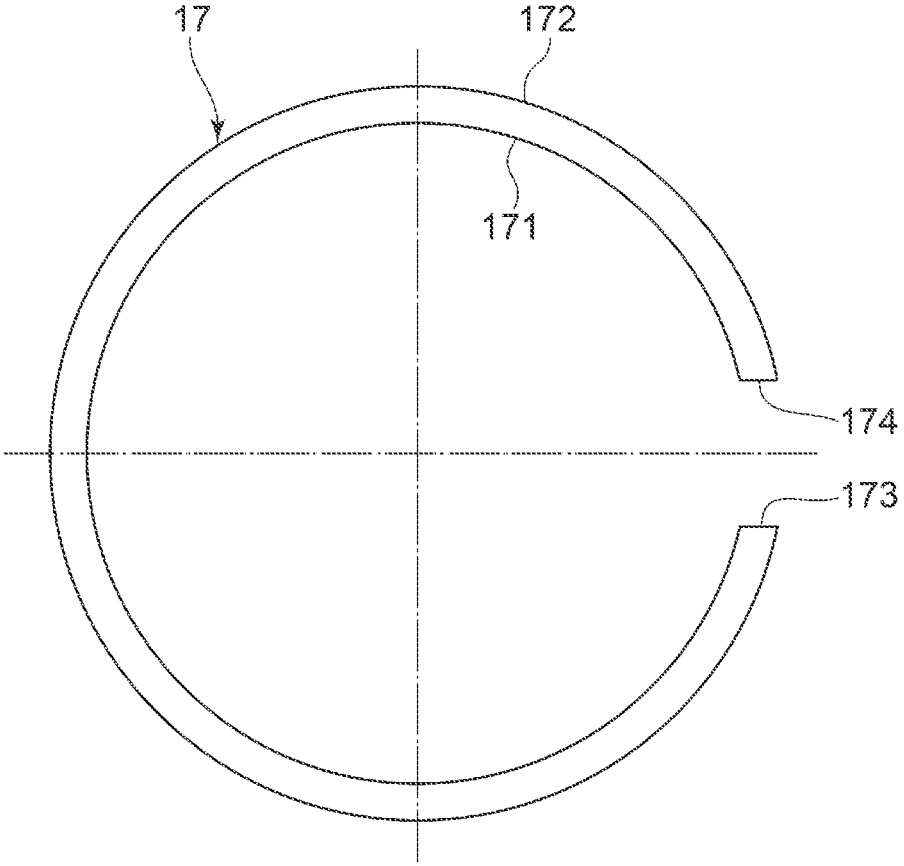
FIG. 5 is a schematic view of a sealing member according to one embodiment.

FIG. 4 is a schematic partially enlarged sectional view showing the sealing mechanism part and its vicinity in an enlarged manner in the supercharger including the compressor wheel device according to one embodiment. FIG. 5 is a schematic view of the sealing member according to one embodiment.

As shown in FIG. 4, according to some embodiments, the wheel body part 5 and the sleeve part 6 are formed integrally using the same material. The sealing groove 62 has a bottom surface 621 configured to form a clearance C between the bottom surface 621 and an inner peripheral surface 171 of the sealing member 17 supported by the housing 8.

As shown in FIG. 5, according to the illustrated embodiment, the sealing member 17 is formed into an arc-like shape having an arc angle equal to or greater than 180 degrees. The sealing member 17 has flexibility. While the sealing member 17 is flexed in such a manner as to make one arc end 173 and the other arc end 174 get closer to each other, the sealing member 17 fits in a sealing groove 146 extending in the through hole 141 of the insert 14 along the peripheral direction. The sealing member 17 presses the bottom surface of the sealing groove 146 using restoring force acting to expand an outer peripheral surface 172 of the sealing member 17 outwardly in the radial direction, thereby being supported on the insert 14. In other words, as shown in FIG. 4, the sealing member 17 is supported on the outer periphery of the rotary shaft 2 by the bearing housing 8B (housing 8) through the insert 14.

As shown in FIG. 4, according to the illustrated embodiment, the sleeve part 6 is configured to form a gap between the outer peripheral surface 61 and the through hole 141 of the insert 14. The sealing groove 62 of the sleeve part 6 is configured to form a gap between a side wall 622 on the other side and a side wall 175 of the sealing member 17 on the other side. The sealing groove 62 of the sleeve part 6 is configured to form a gap between a side wall 623 on the one side and a side wall 176 of the sealing member 17 on the one side.

Generally, for encouraging weight reduction of the compressor wheel 4, a low-strength material such as aluminum or an aluminum alloy is used in some cases as a material for the compressor wheel 4. If the wheel body part 5 and the sleeve part 6 are formed integrally, the sleeve part 6 may be made of a low-strength material. According to the foregoing configuration, as the bottom surface 621 of the sealing groove 62 is configured to form the clearance C between the bottom surface 621 and the inner peripheral surface 171 of the sealing member 17 supported by the housing 8, it is possible to prevent wear or damage of the sealing groove 62 of the sleeve part 6 as a result of sliding motion relative to the sealing member 17.

According to some other embodiments, if the wheel body part 5 and the sleeve part 6 are separate parts, the sealing groove 62 may be configured to form the clearance C.

As shown in FIG. 4, according to some embodiments, the wheel body part 5 and the sleeve part 6 are formed integrally using the same material. Surface treatment process for improving at least one of rigidity and sliding performance is performed on an area of the sleeve part 6 including the sealing groove 62.

The surface treatment process includes at least one of chemical conversion process, plating process, alumite process, Teflon (registered trademark) coating process, Teflon impregnation process, and a combination of these processes.

The plating process may be nickel plating, zinc plating, or electroless nickel plating for improving rigidity, or Kaniflon plating (Teflon composite electroless nickel plating) or electroless nickel-boron plating for improving rigidity and sliding performance.

As described above, aluminum or an aluminum alloy may be used at the sleeve part 6. If these materials are used at the sealing groove 62 likely to make sliding motion relative to a different member, wear or damage may develop easily due to insufficient rigidity or galling may be caused easily due to bad sliding performance. According to the foregoing configuration, as the surface treatment process for improving at least one of rigidity and sliding performance is performed on an area of the sleeve part 6 including the sealing groove 62, it is possible to prevent wear or damage of the sealing groove 62 due to insufficient rigidity or to prevent the occurrence of galling.

As shown in FIGS. 2 and 3, according to some embodiments, the wheel body part 5 and the sleeve part 6 are formed integrally using the same material. With a maximum outer diameter of the hub 51 defined as D (see FIG. 1), a position of connection P1 between the wheel body part 5 and the sleeve part 6 is configured to be separated from a maximum outer diameter position P2 of the hub 51 by 0.03 D (3% of D) or more in the axis direction.

As shown in FIGS. 2 and 3, according to the illustrated embodiment, the maximum outer diameter position P2 is located at an edge of the disk part 51A on the other side. In other words, the maximum outer diameter position P2 is located at the outer peripheral edge of the back surface 54 of the wheel body part 5. According to the illustrated embodiment, the position of connection P1 is configured to be within 0.09 D (9% of D) from the maximum outer diameter position P2 of the hub 51 in the axis direction. This makes it possible to prevent increase in the length of the compressor wheel 4 in the axis direction.

Figure 6:
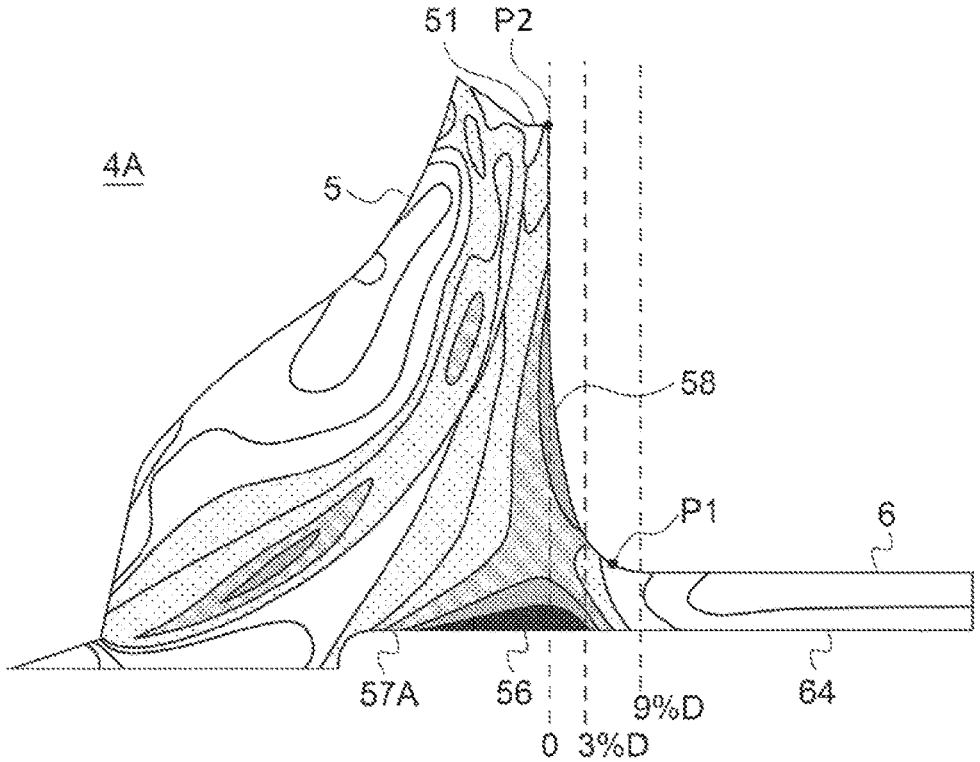
FIG. 6 is a view showing a von Mises stress distribution about a compressor wheel having a through-bore configuration.
Figure 7:
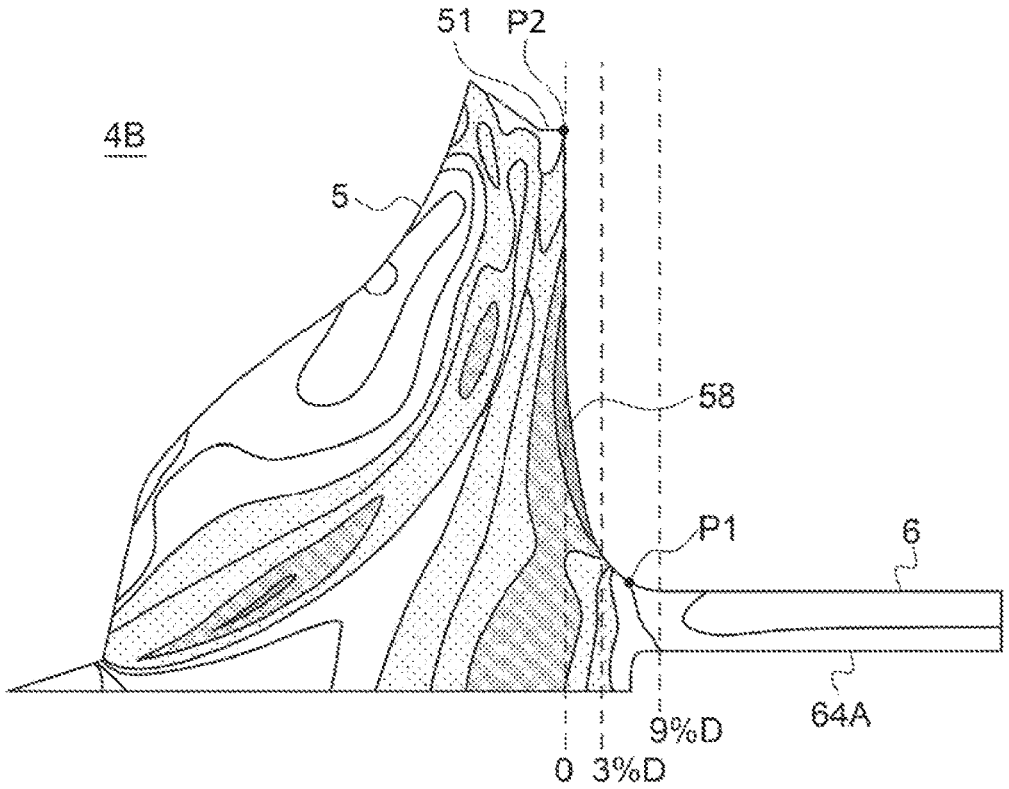
FIG. 7 is a view showing a von Mises stress distribution about a compressor wheel having a boreless configuration.
Figure 8:
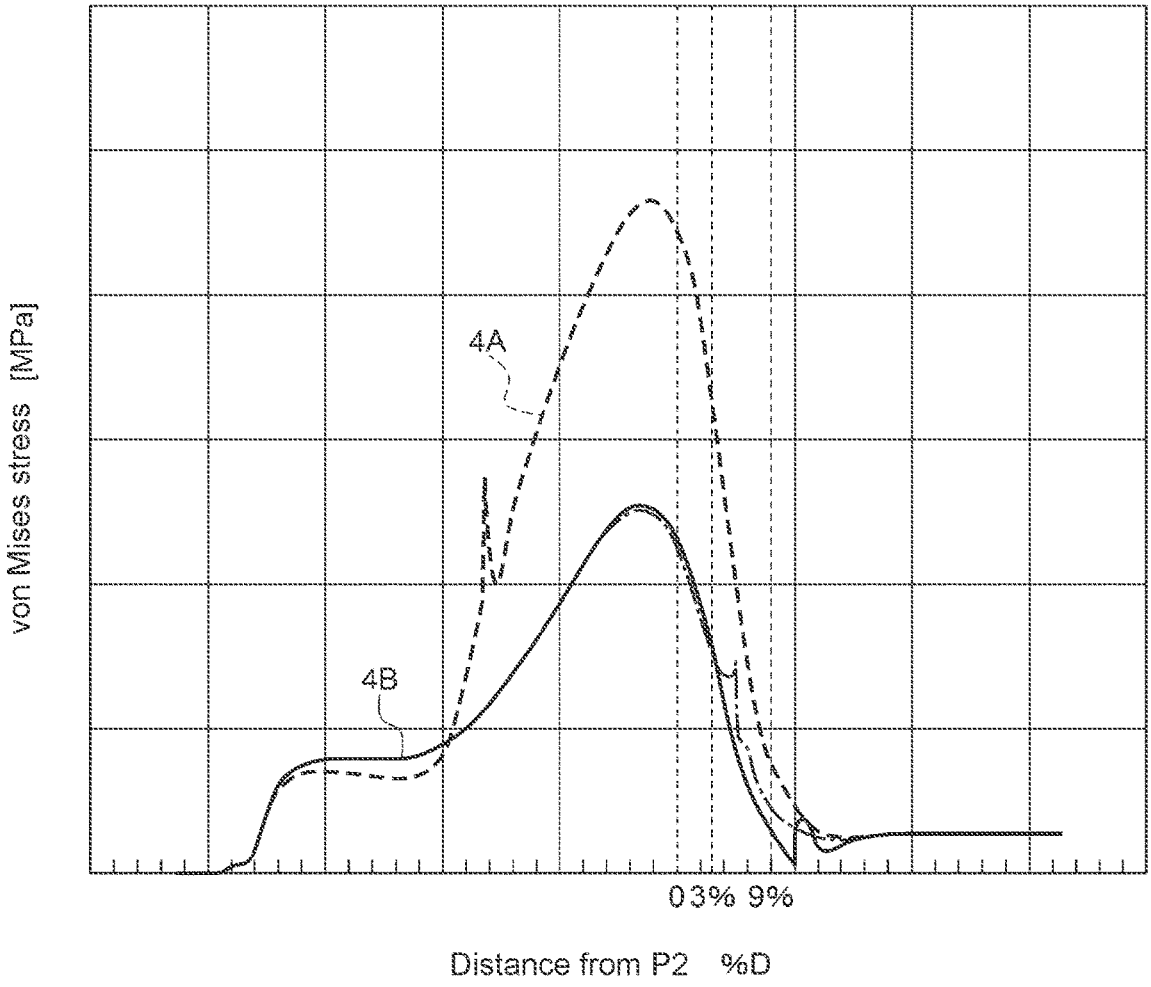
FIG. 8 is a graph showing von Mises stress distributions taken along center axes of the compressor wheels having the through-bore configuration and the boreless configuration.

FIG. 6 is a view showing a von Mises stress distribution about a compressor wheel having a through-bore configuration. FIG. 7 is a view showing a von Mises stress distribution about a compressor wheel having a boreless configuration. FIG. 8 is a graph showing von Mises stress distributions taken along center axes of the compressor wheels having the through-bore configuration and the boreless configuration. Each of FIGS. 6 to 8 is plotted using result of strength analysis.

As shown in FIG. 6, in a compressor wheel 4A having the through-bore configuration, a hole 57A (corresponding to the through hole 57) is formed inside the maximum outer diameter position P2 in the radial direction, and an inner peripheral side stress concentration part 56 occurs in the vicinity of an inner peripheral surface of the hole 57A. As shown in FIG. 7, in a compressor wheel 4B having the boreless configuration, the inner peripheral side stress concentration part 56 does not occur as the hole 57A is not formed inside the maximum outer diameter position P2 in the radial direction.

As shown in FIGS. 6 and 7, in each of the compressor wheels 4A and 4B, a back surface side stress concentration part 58 occurs in the vicinity of the back surface 54 located inside the maximum outer diameter position P2 in the radial direction. The back surface side stress concentration part 58 does not occur at a position separated from the maximum outer diameter position P2 of the hub 51 by 0.03 D (3% of D) or more in the axis direction.

As shown in FIG. 8, with respect to stress (peak stress) occurring at the maximum outer diameter position P2, stress occurring at a position separated from the maximum outer diameter position P2 of the hub 51 by 0.03 D (3% of D) in the axis direction is equal to or less than 50% of the peak stress.

Centrifugal stress becomes maximum in the vicinity of the maximum outer diameter position P2 of the hub 51 in the axis direction. According to the foregoing configuration, with a maximum outer diameter of the hub 51 defined as D, the position of connection P1 between the wheel body part 5 and the sleeve part 6 is configured to be separated from the maximum outer diameter position P2 of the hub 51 by 0.03 D or more in the axis direction. This allows reduction in the centrifugal stress acting on the position of connection P1. Reducing the centrifugal stress acting on the position of connection P1 allows reduction in the outer diameter of the sleeve part 6, making it possible to prevent increase in the peripheral length of the sealing mechanism part 18 of the supercharger 1.

As shown in FIGS. 2 and 3, according to some embodiments, the wheel body part 5 and the sleeve part 6 are formed integrally using the same material. A connection 41 between the wheel body part 5 and the sleeve part 6 is formed into an arc-like shape recessed into the compressor wheel 4 taken at a section including an axis line direction of the rotary shaft 2.

According to the foregoing configuration, as the connection 41 between the wheel body part 5 and the sleeve part 6 is formed into an arc-like shape recessed into the compressor wheel 4 taken at a section including the axis line direction of the rotary shaft 2, it is possible to prevent the occurrence of stress concentration at the connection 41. Preventing the occurrence of stress concentration at the connection 41 allows reduction in the outer diameter of the sleeve part 6, making it possible to prevent increase in the peripheral length of the sealing mechanism part 18 of the supercharger 1.

As described above, according to some embodiments, the sleeve part 6 has the inner peripheral surface 64A provided with the screw groove 65 with which the rotary shaft 2 is threadedly engaged, as shown in FIG. 3.

According to the foregoing configuration, the compressor wheel 4 has what is called a boreless configuration of being coupled to the rotary shaft 2 mechanically by threadedly engaging the rotary shaft 2 with the screw groove 65 formed at the inner peripheral surface 64A of the sleeve part 6 separated from the maximum outer diameter position P2 of the hub 51. The foregoing configuration allows reduction in the occurrence of the inner peripheral side stress concentration part 56 (stress concentration part). As compared to the through-bore configuration, this eliminates the need to increase creep strength at the wheel body part 5 to allow corresponding reduction in material cost for the wheel body part 5.

According to some embodiments described above, the wheel body part 5 and the sleeve part 6 are formed integrally using the same material. Alternatively, according to some other embodiments, the wheel body part 5 and the sleeve part 6 may be separate parts, or the wheel body part 5 and the sleeve part 6 may be made using different materials.

Figure 9:
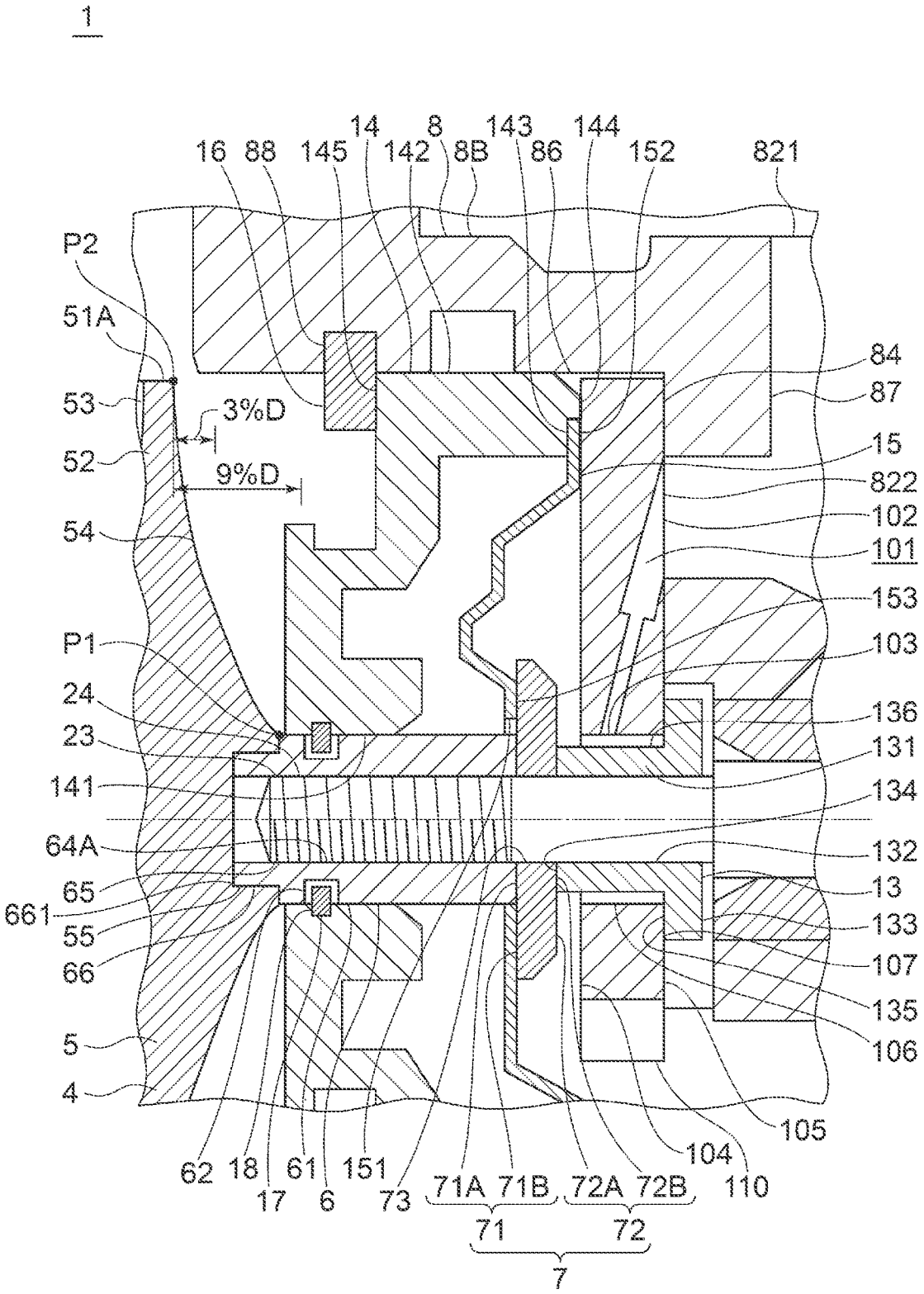
FIG. 9 is a schematic partially enlarged sectional view corresponding to FIG. 2 showing a compressor wheel device according to a different embodiment.

FIG. 9 is a schematic partially enlarged sectional view corresponding to FIG. 2 showing a compressor wheel device according to a different embodiment.

As shown in FIG. 9, according to some embodiments, the sleeve part 6 includes one end portion 66 configured to be fixedly coupled to the wheel body part 5 by being press-fitted into a recess 55 formed at the back surface 54 of the hub 51, and is formed using a material having higher wear resistance than that of the wheel body part 5.

As shown in FIG. 9, according to the illustrated embodiment, the one end portion 66 has an outer peripheral surface of a smaller diameter than the outer peripheral surface 61 of the sleeve part 6 on which the sealing groove 62 is formed.

According to the foregoing configuration, as press-fitting the one end portion 66 of the sleeve part 6 into the recess 55 of the hub 51 makes the wheel body part 5 and the sleeve part 6 integral with each other, work of fitting the wheel body part 5 and the sleeve part 6 is done easily. Furthermore, as the wheel body part 5 and the sleeve part 6 are fitted on the supercharger 1 while being integral with each other, favorable fitting performance is achieved. Thus, the foregoing configuration makes it possible to suppress increase in manufacturing cost occurring by forming the wheel body part 5 and the sleeve part 6 as separate parts. Furthermore, as the sleeve part 6 having the sealing groove 62 is made of a material of higher wear resistance than that of the wheel body part 5, it is possible to prevent wear or damage of the sealing groove 62.

As shown in FIG. 9, according to some embodiments, the wheel body part 5 and the sleeve part 6 are separate parts. The one end portion 66 has a tip 661 configured to be located closer to the back surface 54 of the compressor wheel 4 (closer to the other side) than the maximum outer diameter position P2 of the hub 51.

According to the illustrated embodiment, the tip 661 of the one end portion 66 is configured to be separated from the maximum outer diameter position P2 of the hub 51 by 0.03 D (3% of D) or more in the axis direction. According to the illustrated embodiment, the tip 661 is configured to be within 0.09 D (9% of D) from the maximum outer diameter position P2 of the hub 51 in the axis direction. This makes it possible to prevent increase in the length of the compressor wheel 4 in the axis direction.

According to the foregoing configuration, the tip 661 of the one end portion 66 of the sleeve part 6 is configured to be located closer to the back surface 54 of the compressor wheel 4 than the maximum outer diameter position P2 of the hub 51. Unlike the through-bore configuration, this makes it possible to reduce the occurrence of the inner peripheral side stress concentration part 56 (stress concentration part) at the wheel body part 5. This eliminates the need to increase creep strength at the wheel body part 5 to allow corresponding reduction in material cost for the wheel body part 5.

As shown in FIG. 9, according to some embodiments, the wheel body part 5 and the sleeve part 6 are separate parts. The sleeve part 6 has the inner peripheral surface 64A provided with the screw groove 65 with which the rotary shaft 2 is threadedly engaged.

According to the foregoing configuration, the compressor wheel 4 is coupled to the rotary shaft 2 mechanically by threadedly engaging the rotary shaft 2 with the screw groove 65 formed at the inner peripheral surface 64A of the sleeve part 6. As the sleeve part 6 with the screw groove 65 is formed using a material having higher wear resistance than that of the wheel body part 5, it is possible to fasten the rotary shaft 2 and the compressor wheel 4 to each other fixedly through the threaded engagement.

As shown in FIG. 1, the supercharger 1 according to some embodiments includes the rotary shaft 2, the compressor wheel device 3, the housing 8 configured to house the compressor wheel device 3, and the sealing member 17 supported by the housing 8 and configured to form the sealing mechanism part 18 between the sealing member 17 and the sealing groove 62.

According to the foregoing configuration, as the supercharger 1 includes the compressor wheel device 3 including the sleeve part 6 with the sealing groove 62, and the sealing member 17 supported by the housing 8 and forming the sealing mechanism part 18 between the sealing member 17 and the sealing groove 62, it is possible to prevent increase in the peripheral length of the sealing mechanism part 18 and to prevent complication of the sealing mechanism part 18. Thus, the foregoing configuration makes it possible to prevent complication of the configuration of the supercharger 1 and to reduce manufacturing cost for the supercharger 1.

The present invention is not limited to the embodiments described above but it includes embodiments configured by making modifications to the foregoing embodiments and embodiments configured by combining such embodiments.

According to some of the foregoing embodiments, the turbocharger including the compressor wheel 4 and the turbine wheel 9 has been described as an example of the supercharger 1. However, the supercharger 1 is not limited to the turbocharger but can be changed in various ways. For example, the supercharger 1 may be a supercharger other than the turbocharger. The supercharger 1 may have a configuration without the turbine wheel 9. The supercharger 1 without the turbine wheel 9 may be a motor-driven compressor configured to rotate the compressor wheel 4 using a motor not shown in the drawings, for example.

REFERENCE SIGNS LIST

1 Supercharger
2 Rotary shaft
3 Compressor wheel device
4, 4A, 4B Compressor wheel
5 Wheel body part
6 Sleeve part
7 Thrust collar
8 Housing
8A Compressor housing
8B Bearing housing
8C Turbine housing
9 Turbine wheel
10 Thrust bearing
11, 12 Journal bearing
13 Turbine-side thrust collar
14 Insert
15 Oil deflector
16 Snap ring
17 Sealing member
18 Sealing mechanism part
19 Nut member
21 Projection
22, 24 Threaded engagement part
23 Tip
40 Through hole
41 Connection
51 Hub
51A Disk part
51B Nose part
52 Outer peripheral surface
53 Blade
54 Back surface
55 Recess
56 Inner peripheral side stress concentration part
57 Through hole
57A Hole
58 Back surface side stress concentration part
61 Outer peripheral surface
62 Sealing groove

63 End surface
64 Through hole
64A Inner peripheral surface
65 Screw groove
66 One end portion
71 One surface
71A, 72B Abutting surface
71B, 72A Slidably-contacting surface
72 The other surface
73 Through hole
74 Projection
81 Internal space
82 Oiling flow path
83 Outer surface
84 Step surface
85 Inner surface
86 Covering part
87 Inward projection
88 Inner peripheral groove
C Clearance
LA Axis line
P1 Position of connection
P2 Maximum outer diameter position

The invention claimed is:

1. A compressor wheel device comprising a rotary shaft, a compressor wheel attached to the rotary shaft, and a thrust collar attached to the rotary shaft behind the compressor wheel, the compressor wheel including:

a wheel body part with a hub and at least one blade provided on an outer peripheral surface of the hub; and a sleeve part having a cylindrical shape projecting along an axis direction from a rear surface of the hub and having an outer peripheral surface on which a sealing groove extending along a peripheral direction is formed, the thrust collar having a circular plate-like shape including:

a first surface including an abutting surface abutting an end surface of the sleeve part and extending along a radial direction; and a second surface including a slidably-contacting surface slidably contacting a thrust bearing supporting the rotary shaft in a thrust direction and extending along the radial direction, wherein the wheel body part and the sleeve part are formed integrally using a same material, wherein the compressor wheel is provided with a through-hole allowing the rotary shaft to pass therethrough along the axis direction, wherein the compressor wheel is attached to the rotary shaft by passing the rotary shaft through the through-hole and screwing a nut onto a projection projecting from a wheel front edge of the rotary shaft, wherein with a maximum outer diameter of the hub defined as D, a position of connection between the wheel body part and the sleeve part is configured to be separated from a maximum outer diameter position of the hub at the rear surface of the hub by 0.03D or more in the axis direction, and wherein the position of connection between the wheel body part and the sleeve part is configured to be within 0.09D from the maximum outer diameter position of the hub at the rear surface of the hub in the axis direction.

2. The compressor wheel device according to claim 1, wherein a clearance is formed between a bottom surface of the sealing groove and an inner peripheral surface of a sealing member supported by a housing of the compressor wheel.

3. The compressor wheel device according to claim 1, wherein a surface treatment process for improving at least one of rigidity and sliding performance is performed on an area of the sleeve part including the sealing groove.

4. The compressor wheel device according to claim 1, wherein a connection portion between the wheel body part and the sleeve part is formed into an arc-like shape recessed into the compressor wheel.

5. A compressor wheel device comprising a rotary shaft, a compressor wheel attached to the rotary shaft, and a thrust collar attached to the rotary shaft behind the compressor wheel, the compressor wheel including:

a wheel body part with a hub and at least one blade provided on an outer peripheral surface of the hub; and a sleeve part having a cylindrical shape projecting along an axis direction from a rear surface of the hub and having an outer peripheral surface on which a sealing groove extending along a peripheral direction is formed, the thrust collar having a circular plate-like shape including:

a first surface including an abutting surface abutting an end surface of the sleeve part and extending along a radial direction; and a second surface including a slidably-contacting surface slidably contacting a thrust bearing supporting the rotary shaft in a thrust direction and extending along the radial direction, wherein the sleeve part includes an end portion having a tip configured to be fixedly coupled to the wheel body part by being press-fitted into a recess formed at the rear surface of the hub, and is formed using a material having higher wear resistance than that of the wheel body part, wherein with a maximum outer diameter of the hub defined as D, each of the tip of the end portion of the sleeve part and a position of connection between the wheel body part and the sleeve part is configured to be separated from a maximum outer diameter position of the hub at the rear surface of the hub by 0.03D or more in the axis direction, and wherein each of the tip of the end portion of the sleeve part and the position of connection between the wheel body part and the sleeve part is configured to be within 0.09D from the maximum outer diameter position of the hub at the rear surface of the hub in the axis direction.

6. The compressor wheel device according to claim 5, wherein the sleeve part has an inner peripheral surface provided with a screw groove with which the rotary shaft is threadedly engaged.

7. The compressor wheel device according to claim 1, wherein the second surface of the thrust collar further includes a collar abutting surface abutting a second thrust collar attached to the rotary shaft.

8. A supercharger comprising:

the compressor wheel device according to claim 1;

a housing configured to house the compressor wheel device; and a sealing member supported by the housing.

9. A supercharger comprising:

the compressor wheel device according to claim 5;

a housing configured to house the compressor wheel device; and a sealing member supported by the housing.

* * * * *